US006755004B1

(12) United States Patent
Power, Jr. et al.

(10) Patent No.: US 6,755,004 B1
(45) Date of Patent: Jun. 29, 2004

(54) SIMPLE LAP BEAM

(75) Inventors: Vincent Thomas Power, Jr., Vero Beach, FL (US); Carol Power, Vero Beach, FL (US)

(73) Assignee: American Pre-Fab, Inc., Fort Pierce, FL (US)

( * ) Notice: Subject to any disclaimer, the term of this patent is extended or adjusted under 35 U.S.C. 154(b) by 0 days.

(21) Appl. No.: 10/100,547

(22) Filed: Mar. 18, 2002

Related U.S. Application Data

(62) Division of application No. 09/506,137, filed on Feb. 17, 2000, now Pat. No. 6,385,941.

(51) Int. Cl.[7] ..... E04C 3/30

(52) U.S. Cl. ..... 52/731.3; 52/63; 52/489.2; 52/579; 52/731.5; 52/732.2; 160/392; 160/395; 160/403

(58) Field of Search ..... 52/726.2, 731.2, 52/712, 731.3, 731.5, 392, 489.2, 579, 656.9, 63, 732.2; 160/392, 395, 403

(56) References Cited

U.S. PATENT DOCUMENTS

| | | | | |
|---|---|---|---|---|
| 1,997,876 A | | 4/1935 | Sheldon | |
| 2,101,349 A | | 12/1937 | Sharp | |
| 2,975,874 A | | 3/1961 | Pagan | |
| 2,990,922 A | | 7/1961 | Rudisill | |
| 3,055,399 A | | 9/1962 | Bush et al. | |
| 3,222,841 A | | 12/1965 | Lipof | |
| 3,382,639 A | | 5/1968 | Smith et al. | |
| 3,417,537 A | | 12/1968 | Wilson | |
| 3,562,992 A | | 2/1971 | Kinsey | |
| 3,601,946 A | * | 8/1971 | Rothemund | 52/395 |
| 3,698,149 A | | 10/1972 | Baker | |
| 3,700,385 A | | 10/1972 | Sherwood | |
| 3,700,395 A | | 10/1972 | Sherwood | |
| 3,789,563 A | | 2/1974 | Toti | |
| 4,570,406 A | | 2/1986 | DiFazio | |
| 4,640,314 A | | 2/1987 | Mock | |
| 4,809,476 A | | 3/1989 | Satchell | |
| 4,905,442 A | * | 3/1990 | Daniels | 52/588 |
| 4,987,717 A | | 1/1991 | Dameron, Jr. | |
| 5,031,083 A | * | 7/1991 | Claesson | 362/249 |
| 5,134,250 A | | 7/1992 | Caveney | |
| 5,657,590 A | * | 8/1997 | Digman et al. | 52/204.61 |
| 5,661,936 A | | 9/1997 | Ellingson | |
| 5,735,097 A | * | 4/1998 | Cheyne | 52/489.1 |
| 5,881,508 A | * | 3/1999 | Irvine et al. | 52/177 |

OTHER PUBLICATIONS

Blueprints, Benada Aluminum, 1977–1979, 38 pages.
Blueprint, Beneda aluminum, Jul. 24, 1978, Industry Standard Lap beam.

(List continued on next page.)

*Primary Examiner*—Carl D. Friedman
*Assistant Examiner*—Yvonne M. Horton
(74) *Attorney, Agent, or Firm*—Brian S. Steinberger; Law Offices of Brian S. Steinberger, P.A.

(57) ABSTRACT

Lap beam connectors for allowing two beams to be joined together without having to use external fasteners such as screws. Each beam has at least one internal pair of receptacles for slidably receiving each end of a plate therein. The plate can be secured to inner walls of the beams by a crimping tool, and the like. The plate allows the weight of the beams and any structure being built to be distributed over the length of the beam instead of just being directly on the ends of the beams. The receptacles can be substantially U-shaped with triangular shaped sidewalls. Another part of the invention allows for attaching two U-shaped beam half sections together by having a nesting ledges/receptacles on at least one of the legs of one beam half sections. While the legs of each beam half overlapped against each other, the nesting ledges/receptacles hold the beam half legs to be held to fixed locations. Fasteners such as screws can be driven through the sides of the beam half legs to interlock the beam half sections to one another. An internal strap can be used to add strength to the beam which will allow the beam to span farther, while further securing beam half sections together.

5 Claims, 10 Drawing Sheets

OTHER PUBLICATIONS

Blueprint, Southeast Extruders and Finishers, Apr. 18, 1984, Industry Standard Snap Beam.
www.elite–2000.com, Product Line, Elite Aluminum Corporation, 6 pages, Year 2,000 printout.
Joseph T. Laterza, *Screen Enclosure Details*, American Aluminum, Jan. 1980 Shows 3/16" straps single and multiple.
Joseph Potts, *Screen Enclosure Details*, Mar. 1979 Shows straps top in table shows 3/16" straps and 3/8" top and bottom.
Joseph T. Laterza, *Screen Enclosure*, National Screen Mfg. Corporation, Jan. 3, 1977 Shows straps top and bottom.
Allen A. Kozich & Associates, *Screen Enclosure*, Dec. 12, 1975 Shows straps top and bottom.

* cited by examiner

Fig. 5B
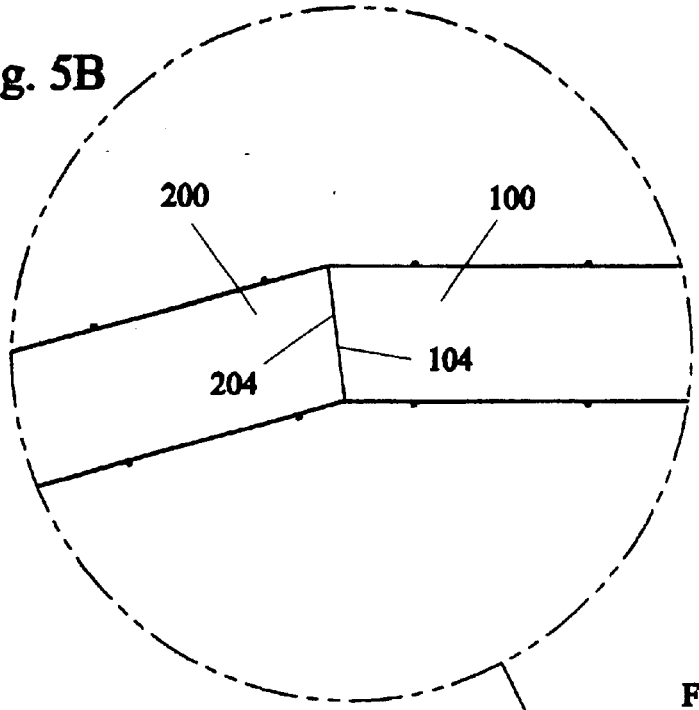
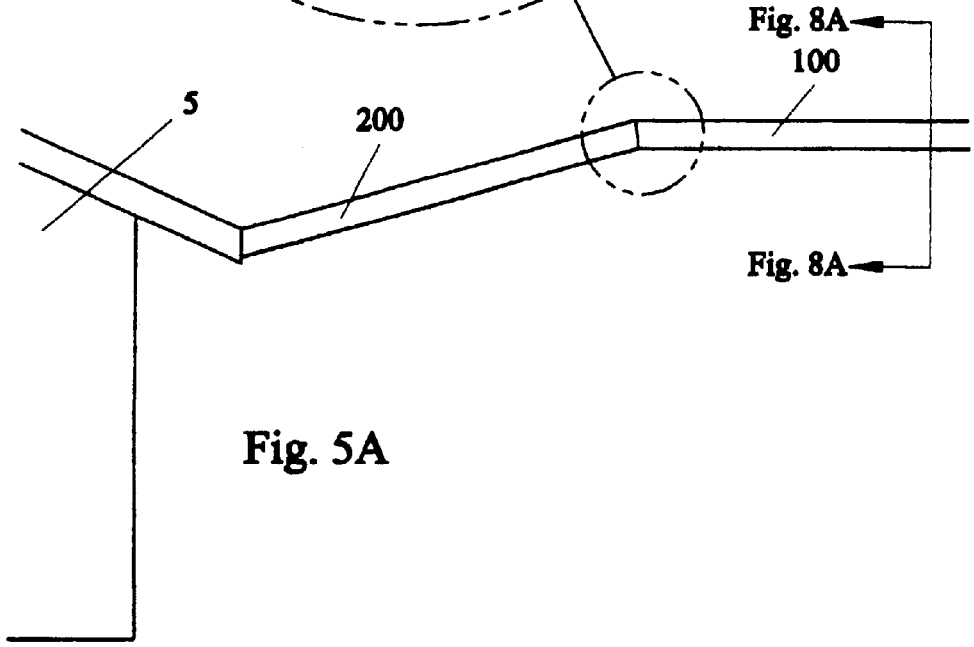
Fig. 5A 100
200

260
200
X
X
320
172
325
160
182

410
450
100
360
200
365
110

326
325
320
322

Z
Y1
Y2

SIMPLE LAP BEAM

This application is a division of application Ser. No. 09/506,317, filed Feb. 17, 2000, now U.S. Pat. No. 6,385, 941.

This invention relates to support beams, and in particular to joint attachments for connecting support beam ends together for use in screened pool cages and screened enclosures; and to structural supports that allow beam half sections to nest together.

BACKGROUND AND PRIOR ART

Pool screen cages and screened enclosures are commonly assembled by connecting multiple metal beams together with plates that all must be screwed and riveted together. An example, of the attachment plates and necessary screw/rivet fasteners used to attach support beams together is shown in FIGS. 1–3C.

FIG. 1 is a perspective view of a basic screened structure enclosure 1 attached to another structure such as a house 5. FIG. 2 is a view of the frame structure of FIG. 1 with upper support beams highlighted. FIG. 3A is a view of the support beam member 10 of FIG. 2 connected to a second support beam 20 using one of a known interior prior art joint attachment plates 30(32, 36). FIG. 3B is an enlarged view of one of the interior prior art joint attachment plates 30 of FIG. 3A. FIG. 3C is another view of the beam members 10, 20 with prior art joint attachment plates 30(32, 36) of FIG. 3A with each of the interior prior art joint attachment plates 32, 36 in a breakaway view, and having multiple fasteners 35, 37 such as screws, and the like, that are necessary to join the plates 32, 36 to the interior halves 12, 22 and 16, 26 of the two support beams 10, 20.

There are many problems with this current type of assembly. The large amount of fasteners such as screws and rivets that must be used with current building techniques is an expensive add-on cost, and requires substantial labor costs during the assembly.

Additional problems occur when dissimilar metals are used during the beam assembly. For example, aluminum beams connected together with nonaluminum fasteners such as nongalvanized steel can have serious drawbacks. Over time, the interaction points between these two dissimilar metals can oxidize and eventually cause the beam connection points to fail seriously undermining the entire structure.

Still another problem with using only fasteners to connect the beams together is that the weight of the beam(s) and structure is centered on the fasteners, thus causing potential weak failure points at the fastener connection points. Merely adding more fasteners can actually reduce the structure's integrity since each fastener cuts into a portion of the beam itself.

Additionally, most metal beams used for pool screen and screened enclosure applications use individual beams that must be assembled together. Each beam has half sections that are fitted to one another and then screwed or riveted. Because each beam half is identical sidewalls, the beam halves must be physically handled and placed in vices, and the like, to make sure that the beam halves are properly aligned so that the beam side walls do not overlap the other beam sidewalls too much. This additional handling causes additional time and labor costs during assembly of the structure. FIG. 4A is a side cross-sectional view of two beam half sections 22, 26 of the prior art. FIG. 4B is another view of FIG. 4A showing a slide problem example of supporting beam half sections 22, 26 apart and in a fixed relationship to one another. Assembly of beam half section 22, 26 is that the beam half sections 22, 26 be fastened and held together in the manner shown in FIG. 4A. However, a common problem is keeping and supporting the beam half sections in this configuration. For example, if beam half section 22 is positioned on top of beam half section 26, the tendency is that the legs 23 of upper beam half section 22 can fall in the direction of arrow J and no longer be adjacent to the legs 27 of beam half section 26 as shown in FIG. 4B.

The inventor is aware of several United States Patents of interest. See for example, U.S. Pat. No 1,997,876 to Sheldon; U.S. Pat. No. 2,990,922 to Rudisill; U.S. Pat. No. 2,975,874 to Pagan; U.S. Pat. No. 3,055,399 to Bush et al.; U.S. Pat. No. 3,382,639 to Smith et al.; U.S. Pat. No. 3,417,537 to Wilson; U.S. Pat. No. 3,700,385 to Sherwood; U.S. Pat. No. 3,789,563 to Toti: U.S. Pat. No. 4,570,406 to DiFazio; U.S. Pat. NO. 4,987,717 to Dameron, Jr.; and U.S. Pat. No. 5,661,936 to Ellingson. However, none of these references adequately overcomes all of the problems with the prior art cited above.

SUMMARY OF THE INVENTION

The first objective of the present invention is to provide a system for cutting beams into architectural designs and re-connecting the beams together without using fasteners such as screws and rivets.

The second object of this invention is to provide a system of connecting beams together with a technique that distributes tile weight of the beams and structure over the length of the beam and not just over the connection points.

The third object of this invention is to provide a system for connecting beams together that requires less hardware, manufacturing time, assembly time and expense compared to conventional techniques.

The fourth object of this invention is to provide a system for connecting beams together that does not require cutting openings into the beams.

The fifth object of this invention is to align two beam half members together to a set position without having to use additional equipment such as vices, and the like.

The sixth object of this invention is to allow the cutting of beam pairs without clamping them in position, by using nesting receptacles for positioning beam halves together.

The seventh object of this invention is to provide internal strengthening members that extend the loads of connection joints along beam spans while using less material.

A preferred embodiment of the lap beam connectors includes a first hollow beam having at least one pair of U-shaped internal receptacles, and a second hollow beam having at least one pair of U-shaped internal receptacle, and internal connection plate that are slidably inserted into the receptacles of both hollow beams for allowing the beams to be joined together without using external connection plates and external fasteners. The receptacles can include triangular shaped prongs for forming a tight fit between the connection plates and the inner walls of the beams. Crimping tools can be used to form indentations in both the plates and the inner sidewalls of the beams in order to help lock the beams and plates together.

An internal support arrangement is formed within each beam so that two beam half sections can be attached together to form a single hollow beam. Each half beam section can include a first upper leg, a first lower leg, and a main portion connecting the first upper leg to the first lower leg. Ledges/receptacles can be provided within the legs of the half beams for allowing the legs of the other half beam to become nested therein in a fixed position. Inner and outer sides of the legs can have grooved surfaces that allow the beam half legs to tightly fit together. Additionally, fasteners such as screws can be provided that pass through the sides of the legs of both beam half sections in order to further lock the beam halves together. Still furthermore, an internal strap can be used that has a first end attached to the fastener, and a second end attached to a ledge/receptacle for further attaching the half beam sections in a fixed arrangement.

Further objects and advantages of this invention will be apparent from the following detailed description of a presently preferred embodiment which is illustrated schematically in the accompanying drawings.

BRIEF DESCRIPTION OF THE FIGURES

FIG. 5A is a perspective view of the novel beam joint attachment invention used and main support beam used instead of the main support beam used in the preceding figures.

FIG. 5B is an enlarged view of the joint attachment of FIG. 5A.

DESCRIPTION OF THE PREFERRED EMBODIMENT

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

FIG. 5A is a perspective view of the novel beam joint attachment invention used for the main support beam. FIG. 5B is an enlarged view of the joint attachment of FIG. 5A. Referring to FIGS. 5A–5B, main support beam includes two longitudinal rectangular aluminum beams 100 and 200 having end 104, 204 joined together.

Figures 6A, 6B, 6C, 6D:
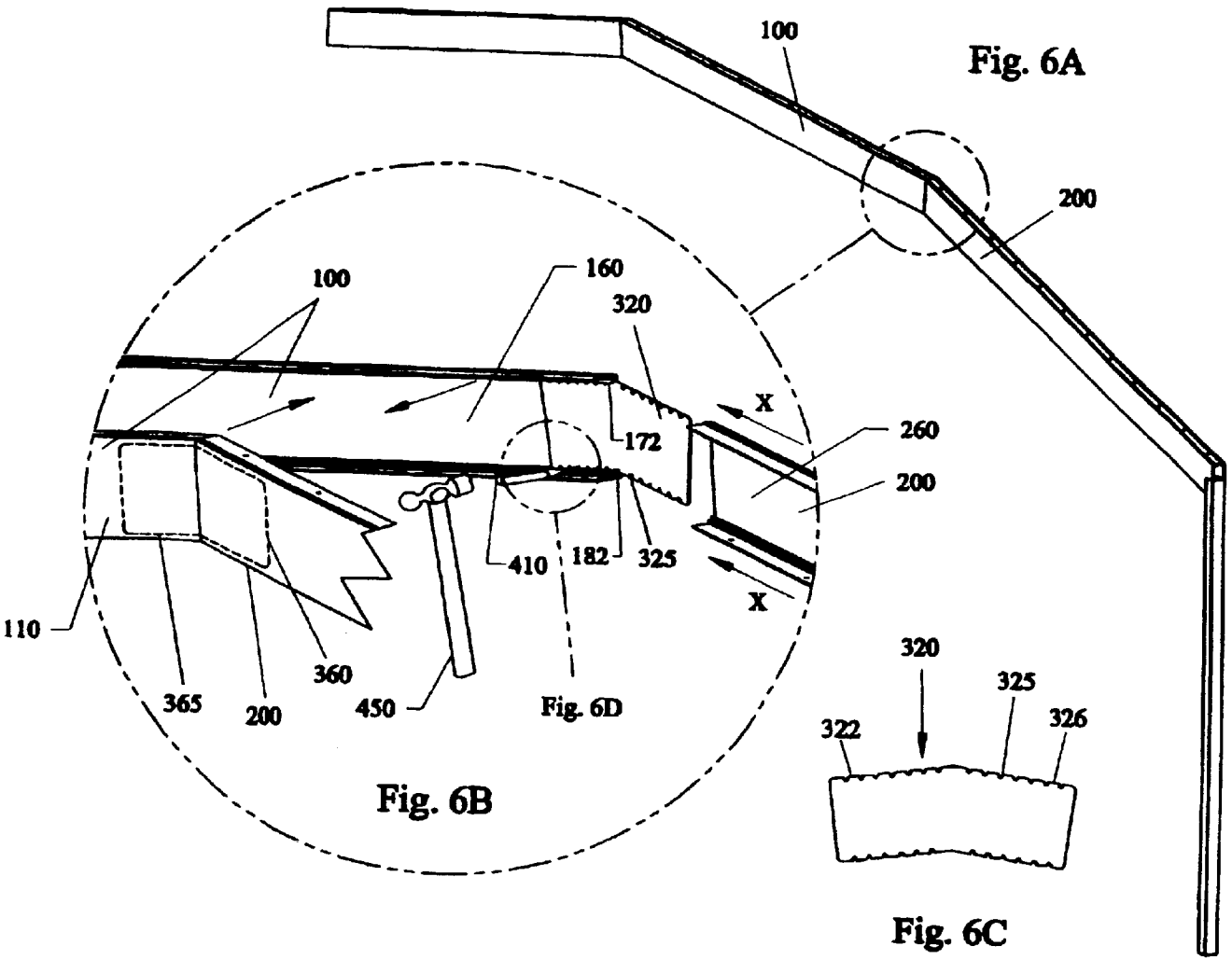
FIG. 6A shows another view of FIG. 5A with a vertical support.
FIG. 6B is an enlarged view of the beam joint of FIG. 6A in a detached position.
FIG. 6C is a side view of a single connection plate used in the joint of FIGS. 6A–6B.
FIG. 6D is an enlarged view of the crimping tool used to insert the connection plate in FIG. 6B.
Figure 6D:
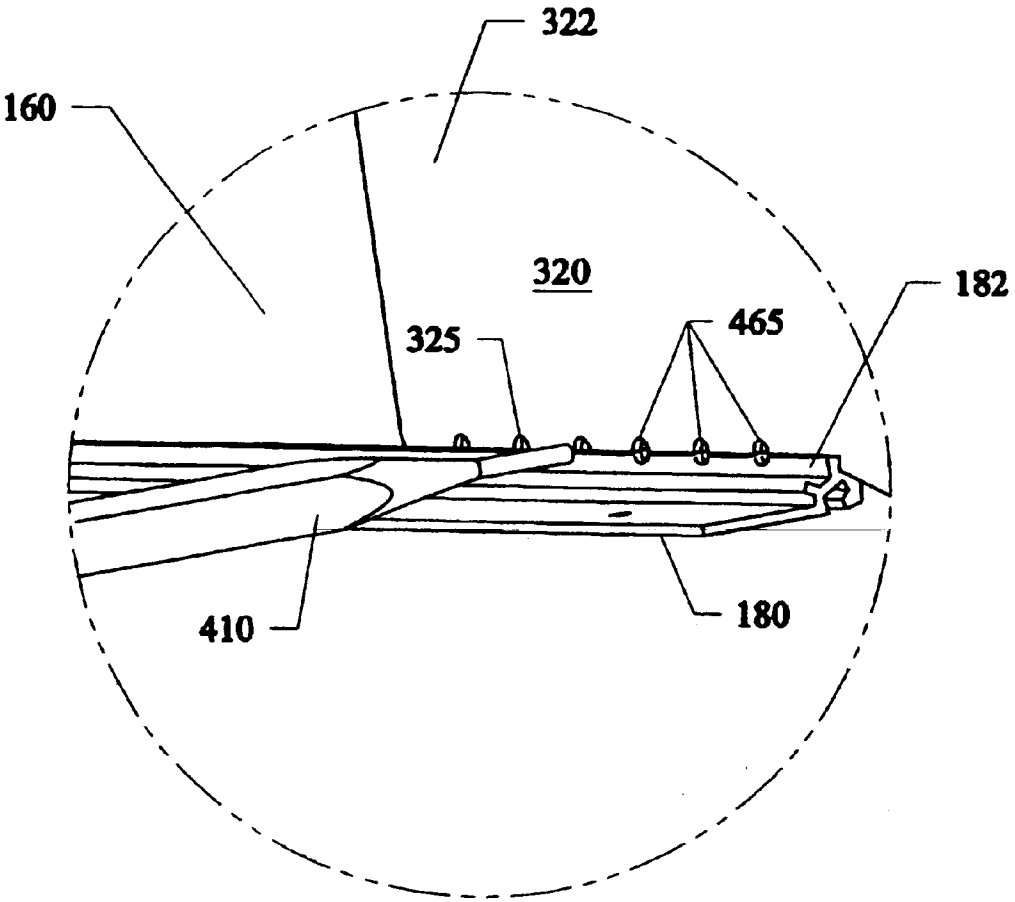

FIG. 6A shows another view of the beams 100, 200 FIG. 5A with a vertical support. FIG. 6B is an enlarged view of the beam joint between beams 100, 200 of FIG. 6A in a detached position. FIG. 6C is a side view of a single connection plate 320 used in the joint of FIGS. 6A–6B. FIG. 6D is an enlarged view of the crimping tool 410, 450 used to attach the connection plate 320 in FIG. 6B.

Figure 1:
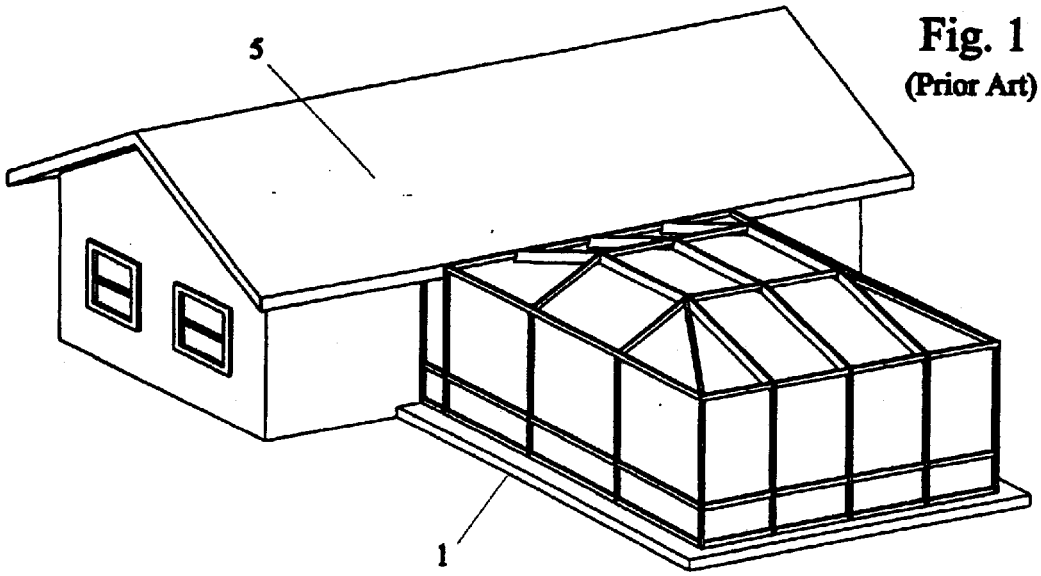
Fig. 1 (Prior Art)
FIG. 1 is a perspective view of a basic screened structure attachment of the prior art.
Figure 2:
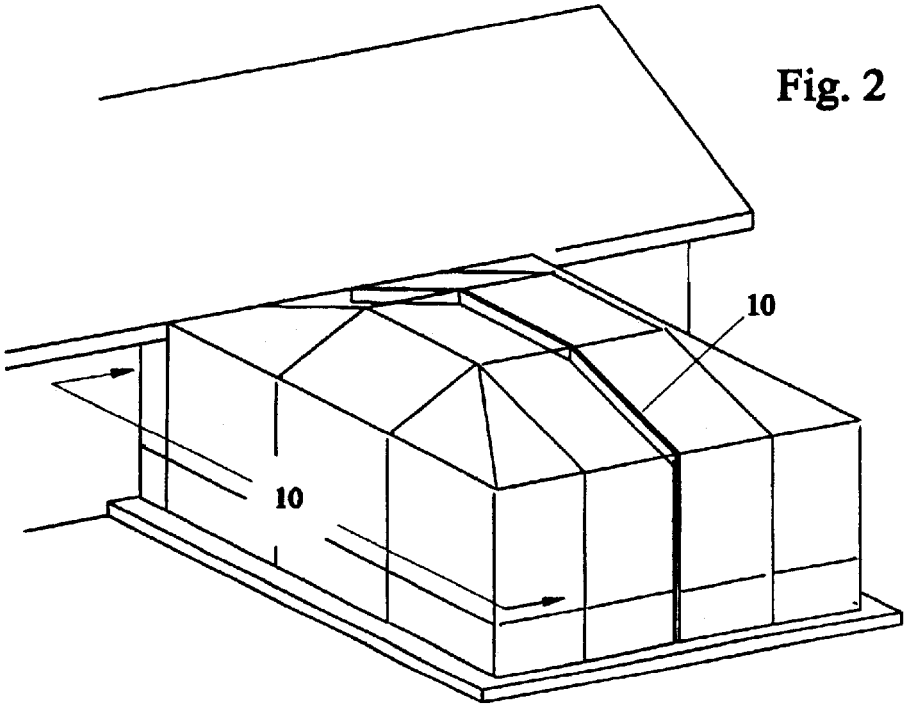
FIG. 2 is a view of the frame structure of FIG. 1 with upper support beams highlighted.
Figures 3A, 3B, 3C:
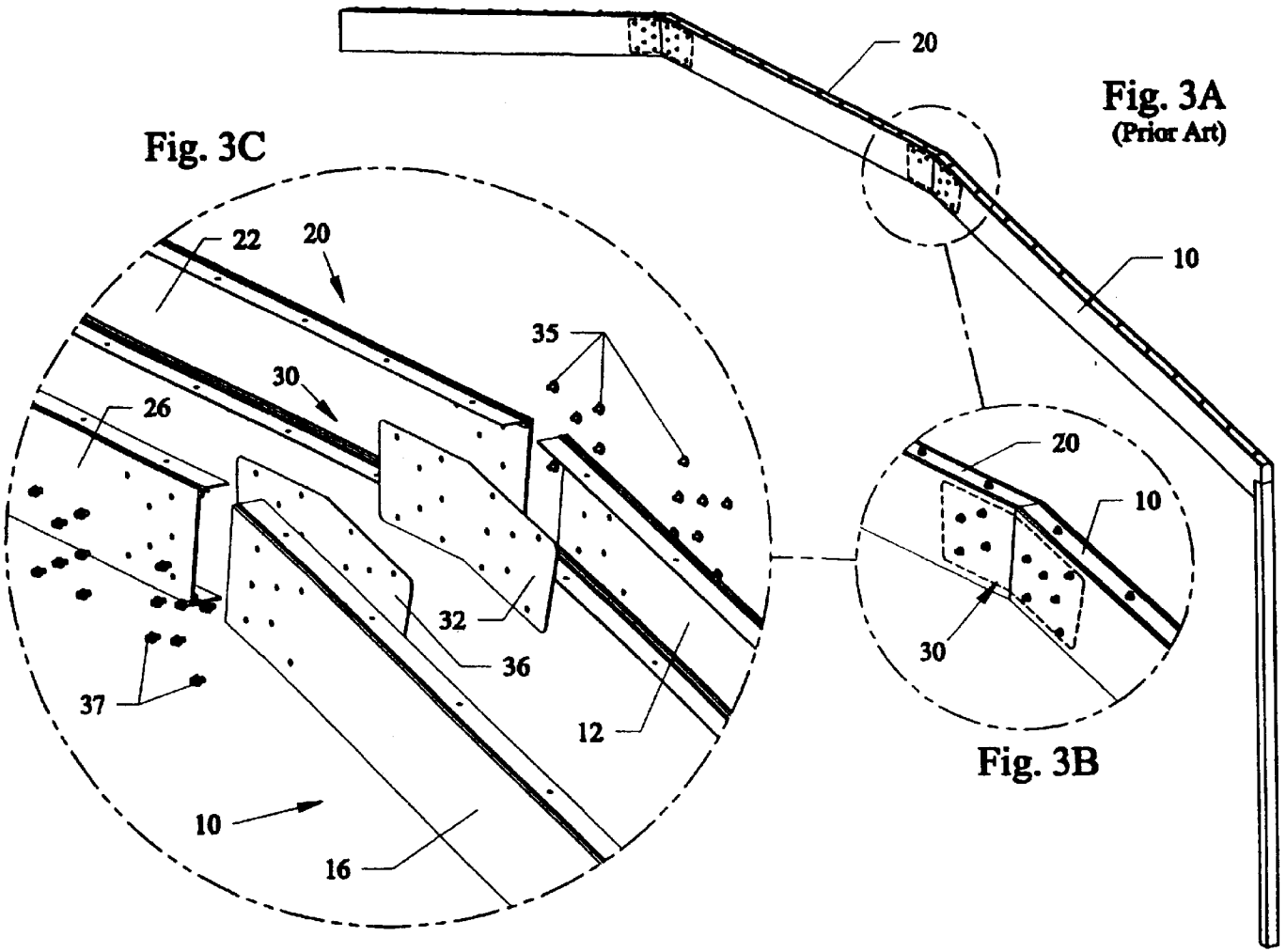
Fig. 3A (Prior Art)
FIG. 3A is a view of the upper support beams of FIG. 2 with prior art joint attachment.
FIG. 3B is an enlarged view of the prior art joint attachment of FIG. 3A.
FIG. 3C is another view of the beams with prior art joint attachment of FIG. 3A with the prior art joint attachment in a breakaway view.

Referring to FIG. 6B–6D, beam 100 is formed from two beam half sections 110, 160. One end 322 of a connection plate 320 is slid within the U-shaped receptacles 173, 183 formed between two inwardly facing prongs 172, 182 and back wall 160(the prongs and receptacles are shown in greater detail in reference to FIGS. 8A–10C. Connection plates 320, 360 have existing notches 325, 365 along the upper and lower longitudinal edges. The installer uses the hammer 450 to hit the strike end of a pin head tool 410 driving the pin head end to be pushed through the sides of the prongs 172, 182 causing individual spaced apart crimps 465 that indent into the notches 325, 365 of the prongs 172, 182, and locks the connection plate 320 to beam half section 160. Beam half section 260 of second beam 200 is similarly slid about end 326 of connection plate 320 and attached in a similar manner. Likewise connection plate 360 is attached to both beam half sections 110 and the front beam half section of second beam 200 in a similar manner. As compared to the prior art shown in FIGS. 3A–3C, none of the exterior fasteners 37 are needed with this novel arrangement of sliding the connection plates therein.

Figure 4A:
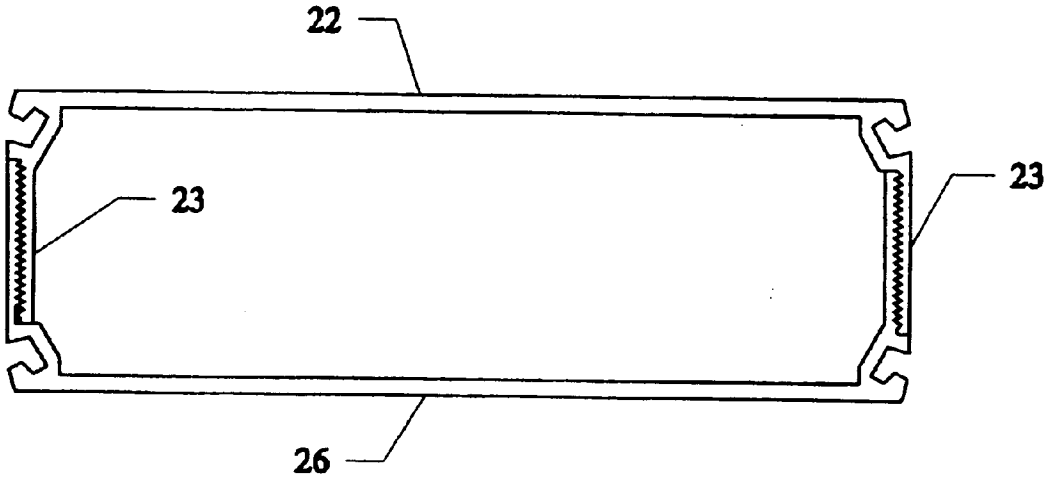
Fig. 4A (Prior Art)
FIG. 4A is a side cross-sectional view of two beam half sections of the prior art.
Figure 4B:
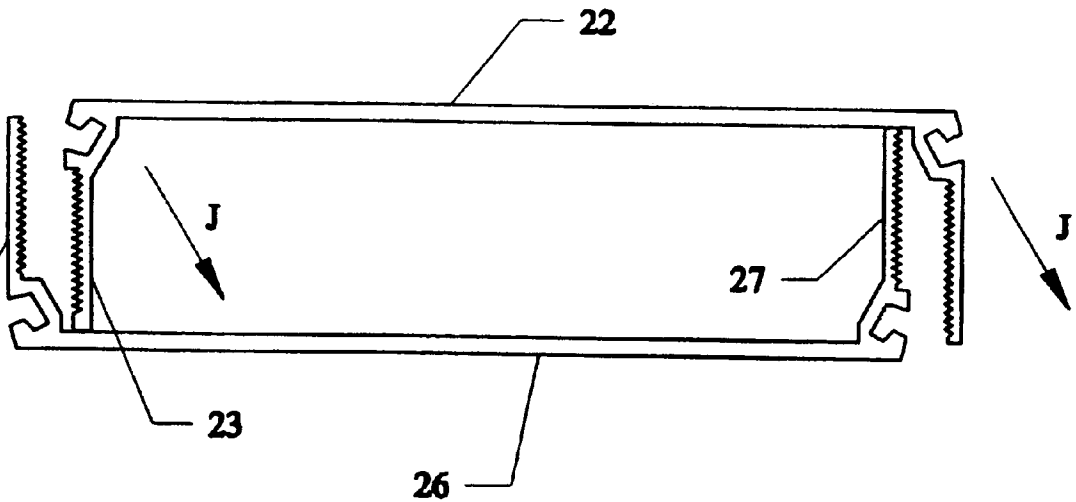
Fig. 4B (Prior Art)
FIG. 4B is another view of FIG. 4A showing the slide problem of supporting beam half sections.
Figure 7:
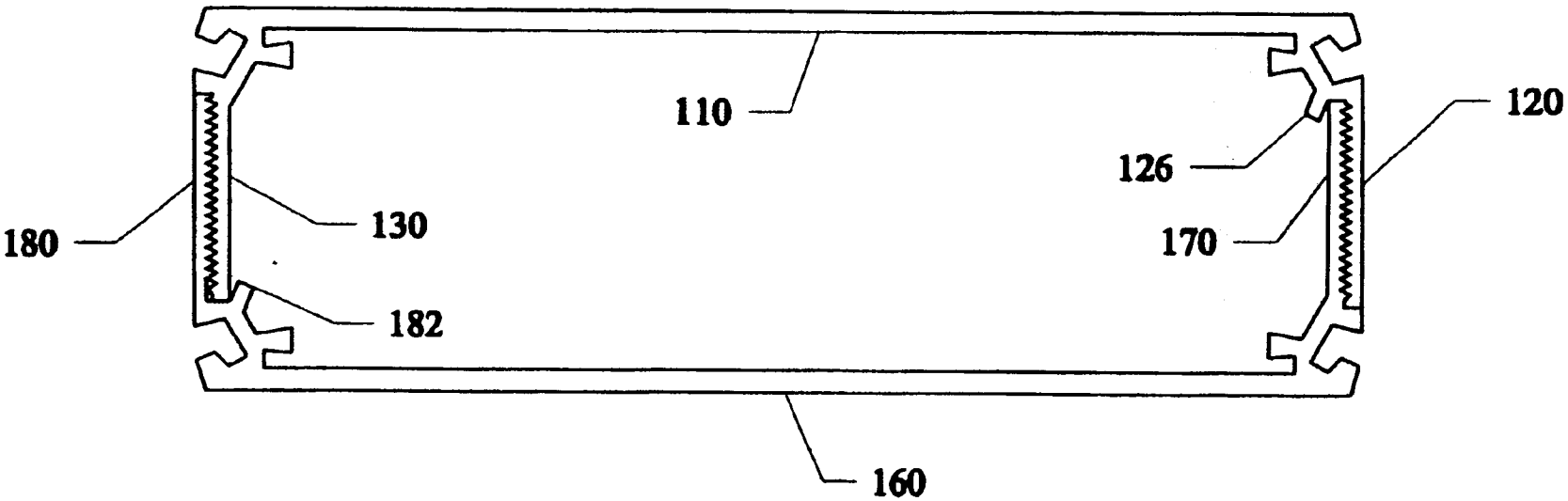
FIG. 7 is a side cross-sectional view of the beam section of FIG. 5A along arrows AA.

FIG. 7 is a side cross-sectional view of the beam half sections 110, 160 of FIG. 5A along arrows AA, which overcomes the slippage support problems of assembling beam half sections described in detail in reference to the prior art shown in FIGS. 4A–4B. Referring to FIG. 7, leg 170 of beam half section 160 abuts and is seated against prong 126 of beam half section 110, while leg 130 of beam half section 110 abuts and is seated against prong 182; of beam half section 160.

Figures 8A, 8B, 9, 10A, 10B, 10C:
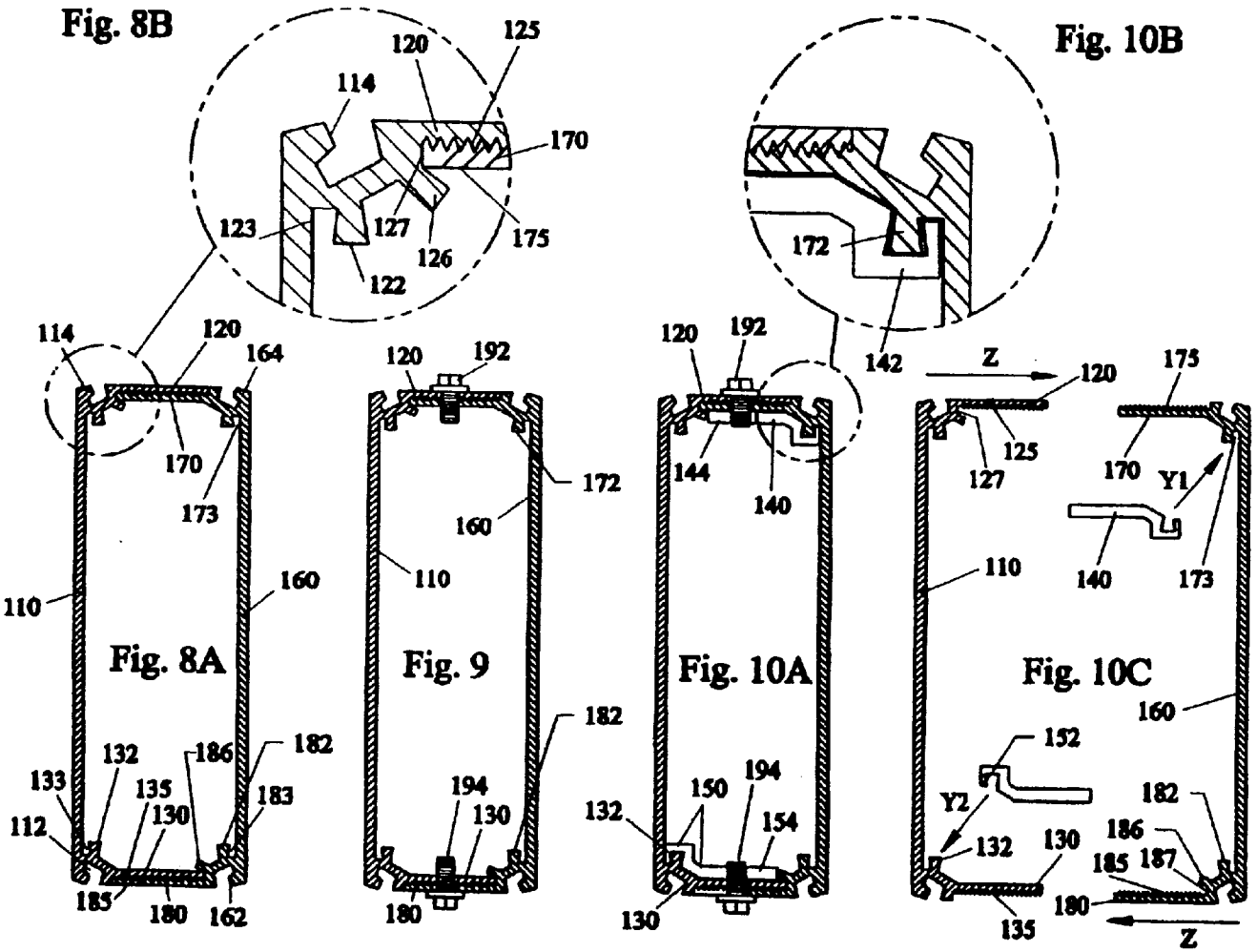
FIG. 8A is another cross-section view of a beam section of FIG. 5A along arrows AA.
FIG. 8B is an enlarged view of a beam cross-section corner of FIG. 8A.
FIG. 9 is another view of the beam cross-section of FIG. 8A secured with fastener screws.
FIG. 10A is a view of the beam cross-section and fastener screws of FIG. 9 with internal straps.
FIG. 10B is an enlarged view of a beam cross-section corner of FIG. 10A.
FIG. 10C is an exploded view of the beam cross-section and internal straps of FIG. 10A.

FIG. 8A is a cross-section view of a beam section of FIG. 5A along arrows AA. FIG. 8B is an enlarged view of a beam section corner of FIG. 8A. Referring to FIGS. 8A–8B, beam cross-section of beam 100 includes two beam half sections 110, and 160. On the exterior of beam half sections 110, and 160 are grooves 112, 114, 162, 164 for receiving spline that is used with screening of enclosures and pools which is not part of the subject invention. Beam half section 110 has legs 120, 130 parallel to one another with grooved surface 125 on the interior surface of leg 120, and a grooved surface 135 on the exterior of leg 130. Two U-shaped receptacles 123, 133 face one another with prongs 122, 132 having triangular shapes and are located in the inside corners of the beam half section 110 adjacent to the legs 120, 130. A nesting receptacle 127 and prong-ledge 126 is formed adjacent the inner corner of where leg 120 meets main section 110. Beam half section 160 has legs 170, 180 parallel to one another with grooved surface 185 on the interior surface of leg 180 and grooved surface 175 on the outer surface of leg 170. A nesting receptacle 187 and prong-ledge 186 is formed adjacent the inner corner of where leg 180 meets the main section of beam half 160. An installer of beam 100 can take beam half 110 and position leg 120 over leg 170 of beam half 160 while simultaneously positioning leg 130 adjacent to leg 180. By overlying the beam half sections 110, 160, the end of leg 170 abuts against nesting receptacles 126–127, while leg 130 abuts against nesting receptacle 186–187, and allows the installer to easily position the beam half sections together. Referring back to FIG. 6B, connecting plates 320, 360 slide into the U-shaped receptacles 123, 133, 173, and 183 allowing beam 100 to be connected to beam 200.

FIG. 9 is another view of the beam cross-section of FIG. 8A secured with fastener screws 192, 194 which can he used to further secure the legs 120, 130, 170, 180 of beam half sections 110 and 160 together.

Figure 11:
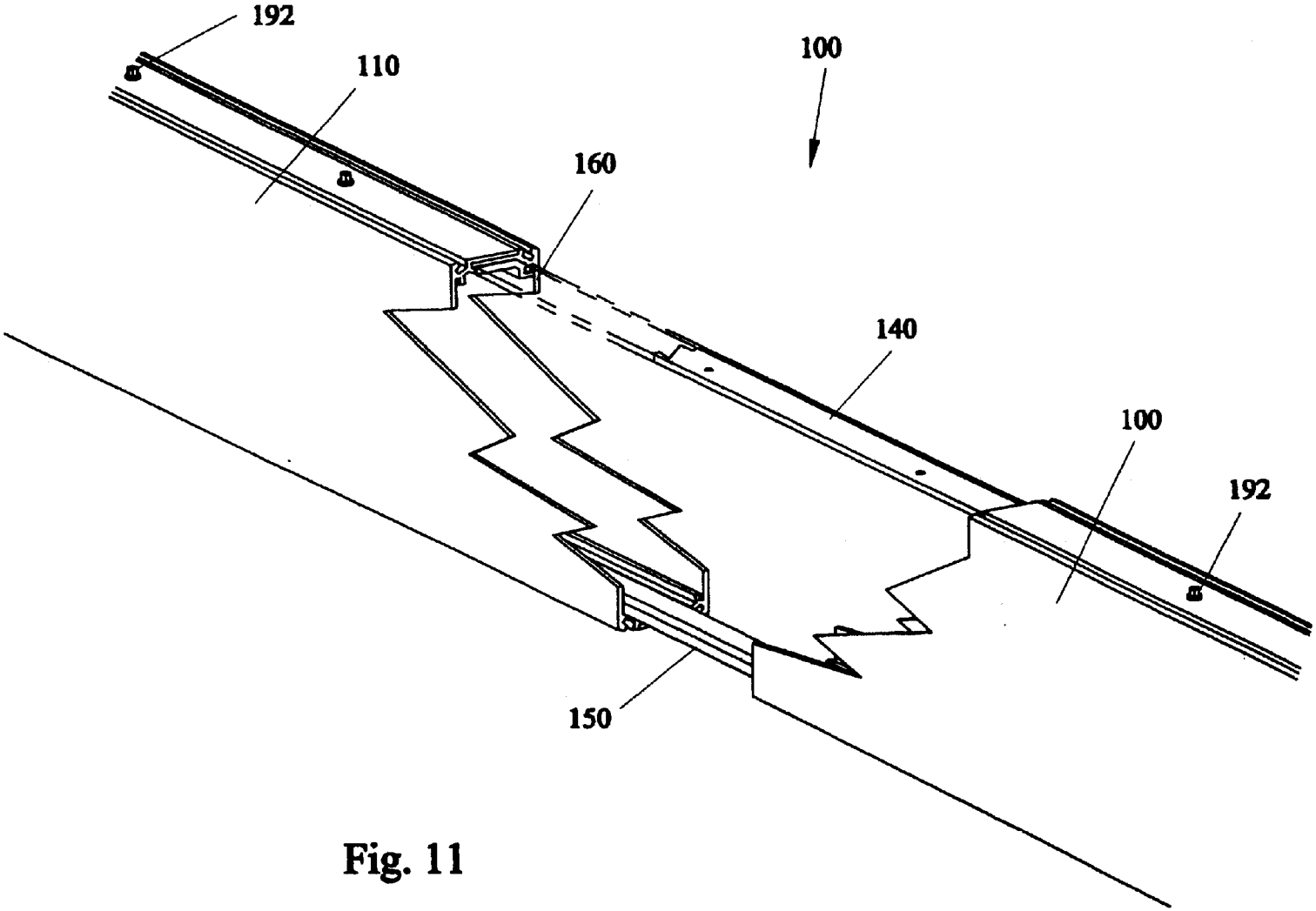
FIG. 11 is a perspective enlarged cut-away view of the internal straps installed in the beam assembly of FIG. 7A.

FIG. 10A is a view of the beam cross-section and fastener screws of FIG. 9 with internal straps 140, 150. FIG. 10B is an enlarged view of a beam cross-section corner of FIG. 10A. FIG. 10C is an exploded view of the beam cross-section and internal straps 140, 150 of FIG. 10A. FIG. 11 is a perspective enlarged cut-away view of the internal straps 140, 150 installed in the beam 100.

Referring to FIGS. 10A–10C, and 11, internal straps 140, 150 can be provided for further securing the beam half sections 110, 160 together. Internal strap 140 is moved in the direction of arrow Y1 and has a hook portion 142 that mateably wraps about prong 172 and an opposite end 144 that is fastened to leg 120 by screw fastener 192. Second internal strap 150 is moved in the direction of arrow Y2 and has a hook portion 152 that mateably wraps about prong 132 and a second end 154 that is fastened to leg 180 by screw fastener 194. Note that beam half sections 110 and 160 are initially put together by being moved in the direction of arrow Z. The internal straps 140, 150 allow the beam to have longer spans that are sturdier than conventional techniques previously described.

Figure 12A:
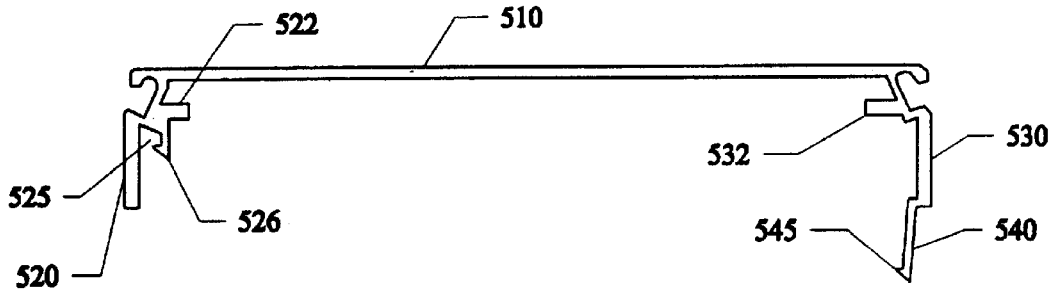
FIG. 12A is a side cross-sectional view of another embodiment of a beam half section.
Figure 12B:
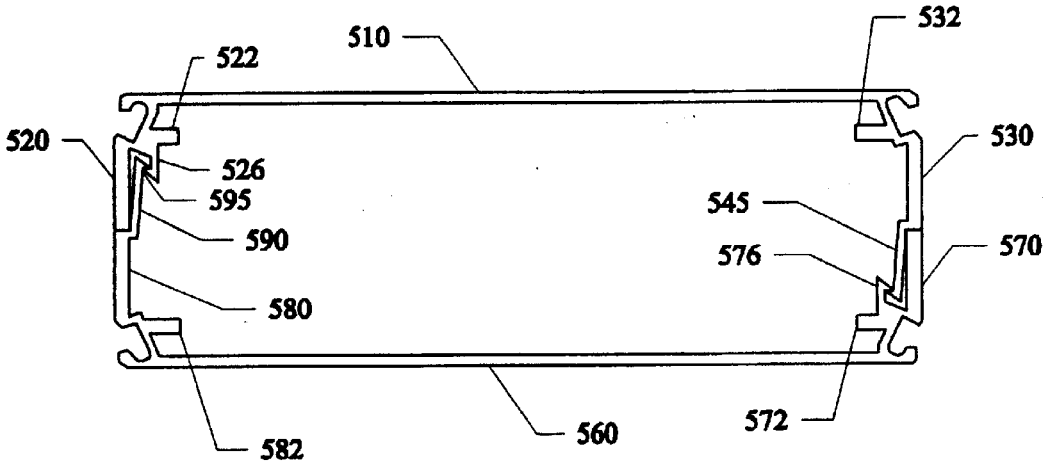
FIG. 12B is a side cross-sectional view of the beam half section of FIG. 12A in a sitting position against a mateable beam half section.

FIG. 12A is a side cross-sectional view of another embodiment of a beam half section. FIG. 12B is a side cross-sectional view of the beam half section of FIG. 12A in a sitting position against a mateable beam half section. FIGS. 12A–12B are a snap beam arrangement where the novel prongs 522, 532, 572, 582 are analogous to the interior prongs 122, 132, 172, 182 for supporting the connection plates 320, 360 shown and described in greater detail in reference to FIGS. 6A–10C. In FIGS. 12A–12B, legs 530, 580 have inwardly facing extension portions 590, 540 each with respective hook ends 595, 545 which snap into and are hooked within mateable hook ended prongs 526, 576 on legs 520, 570. Similar to the previous Figures, extra fasteners and straps can also be used.

The beam half sections and all internal structural shapes described above can be formed by techniques such as extrusions, molds, and the like.

While the preferred invention has been described as being used with rectangular cross-sectional shaped beams, the invention can be used with other cross-sectional shaped beams such as but not limited to square, cylindrical, and the like.

Although the preferred embodiments describes using the invention with aluminum beams, the invention can be used with other types of beam materials such as but not limited to galvanized metal, steel, plastic, fiberglass, combinations thereof, and the like.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

We claim:

1. A beam for use in screened cages and screened enclosures, comprising in combination:

a first half beam having a longitudinal section portion with a pair of legs extending to one side of the section portion;

a second half beam having a longitudinal section portion with a pair of legs extending to one side of the section portion, the pair of legs of the first half beam and the pair of legs of the second half beam being arranged to overly one another to form a full beam; and a strap attached to at least one internal protruding portion of one of the legs of the first half beam and the second half beam for enhancing sturdiness of the full beam, the internal protruding portion of the leg having a triangular shaped prong, the strap including a hook portion and having a longitudinal length with one end portion which abuts against a portion of one of the pair of legs of the first half beam, and a second end portion which abuts against a portion of one of the pair of legs of the second half beam.

2. The beam of claim 1, wherein the strap includes: a hook portion attached about the prong.

3. The beam of claim 1, wherein the strap includes:

a first portion that is attached to a first portion of one leg of the pair of legs of the first half beam; and a second portion that is attached to a second portion of said one leg of the pair of legs of the second half beam.

4. A beam for use in screened cages and screened enclosures, comprising in combination:

a first half beam having a longitudinal section portion with a pair of legs extending to one side of the section portion;

a second half beam having a longitudinal section portion with a pair of legs extending to one side of the section portion, the pair of legs of the first half beam and the pair of legs of the second half beam being arranged to overly one another to form a full beam; and an internal strap having a hook portion attached to at least one internal protruding portion of one of the legs of the first half beam and the second half beam for enhancing sturdiness of the full beam, the internal protruding portion of the leg having a triangular shaped prong.

5. A first half beam having a longitudinal section portion with a pair of legs extending to one side of the section portion;

a second half beam having a longitudinal section portion with a pair of legs extending to one side of the section portion, the pair of legs of the first half beam and the pair of legs of the second half beam being arranged to overly one another to form a full beam; and a strap member attached to at least one internal protruding portion of one of the legs of the first half beam and the second half beam for enhancing sturdiness of the full beam, the internal protruding portion of the leg having a triangular shaped prong, the strap member having a first hook portion that is attached to a first portion of one leg of the pair of legs of the first half beam, and a second hook portion that is attached to a second portion of said one leg of the pair of legs of the second half beam.

* * * * *